US007453244B1

(12) United States Patent
Doyle

(10) Patent No.: US 7,453,244 B1
(45) **Date of Patent: *Nov. 18, 2008**

(54) LOW DROPOUT REGULATOR WITH CONTROL LOOP FOR AVOIDING HARD SATURATION

(75) Inventor: James T. Doyle, Nederland, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/699,198

(22) Filed: Jan. 29, 2007

Related U.S. Application Data

(63) Continuation of application No. 11/129,880, filed on May 16, 2005, now Pat. No. 7,170,269.

(51) Int. Cl.
*G05F 1/56* (2006.01)

(52) U.S. Cl. ..... 323/280

(58) Field of Classification Search ..... 323/273, 323/274, 280, 282, 284, 349, 351; 327/541
See application file for complete search history.

(56) References Cited

U.S. PATENT DOCUMENTS

| | | | | |
|---|---|---|---|---|
| 6,310,467 | B1 | 10/2001 | Sauer | |
| 6,522,122 | B2 | 2/2003 | Watanabe et al. | |
| 6,603,292 | B1 | 8/2003 | Schouten et al. | |
| 6,700,360 | B2 | 3/2004 | Biagi et al. | |
| 6,703,815 | B2 | 3/2004 | Biagi | |
| 7,030,677 | B2 | 4/2006 | Pannwitz | |
| 7,170,269 | B1 * | 1/2007 | Doyle | 323/280 |

* cited by examiner

*Primary Examiner*—Adolf Berhane

(57) ABSTRACT

A hard saturation mode of operation can be avoided in an LDO regulator by providing an additional feedback control loop. The additional control loop cooperates with the LDO regulator's amplifier stage and output stage to maintain at least a minimum desired voltage drop across the output stage from the power supply to the load.

20 Claims, 6 Drawing Sheets

LOW DROPOUT REGULATOR WITH CONTROL LOOP FOR AVOIDING HARD SATURATION

This application is a continuation of prior U.S. patent application Ser. No. 11/129,880 filed on May 16, 2005 now U.S. Pat. No. 7,170,269.

TECHNICAL FIELD OF THE INVENTION

The invention relates generally to electronic circuits and, more particularly, to low dropout (LDO) regulator circuits.

BACKGROUND OF THE INVENTION

Recent growth in portable, battery-operated devices has fueled the growth of the low dropout (LDO) voltage regulator market. The LDO regulator is characterized by its low dropout voltage. Dropout voltage is the difference between the LDO regulator's input voltage (an unregulated voltage received from an unregulated source, such as a battery or a transformer) and the LDO regulator's output voltage (regulated voltage). LDO regulators are particularly useful in portable devices such as portable telephones, pagers, personal digital assistants (PDA), portable personal computers, camcorders, digital cameras, etc.

FIG. 1 diagrammatically illustrates an LDO regulator circuit according to the prior art. The LDO regulator of FIG. 1 includes an amplifier stage A having a non-inverting input 11 and an inverting input 12, and having an output 13. In the example of FIG. 1, an input terminal 16 is coupled to the non-inverting input 11 by a resistor R3. The output 13 of the amplifier A is coupled to the gate of a P-channel transistor P which forms an output stage of the LDO regulator. The source terminal 14 of transistor P is coupled to the positive power supply rail 17, and the drain terminal 15 of transistor P is coupled to a load L. Resistor R1 is coupled between the drain 15 of transistor P and the inverting input 12 of amplifier stage A. Resistor R1 and a further resistor R2 form a feedback control loop circuit 19 that sets the gain of the LDO regulator.

In some applications, for example GSM cellular telephones, the load L of FIG. 1 is an RF amplifier for amplifying RF communication signals and transmitting the amplified signals 47 on an RF communication channel according to a TDMA (time division multiple access) scheme. The LDO regulator output at 15 controls TDMA operation of the RF amplifier in response to the LDO input at 16. The input terminal 16 can be driven by a precision ramp signal provided by a high performance digital-to-analog converter (DAC) in a baseband IC of the cellular telephone. In such applications, adjacent channel interference and sideband noise are to be avoided, so noise and linearity are a major concern. Moreover, it is well known that the sideband noise typically gets worse when the LDO is near saturation. The dynamic range is effectively reduced, and the noise floor increases.

When the amplifier stage A enters the saturation mode, power supply rejection reduces to near zero. This is because the amplifier A turns on the transistor P as hard as possible, so P no longer acts as a current source, but rather becomes a resistor which has no power supply rejection. When the amplifier A enters the saturation mode and the transistor P is turned on as hard as possible, this is a condition from which recovery can be difficult.

FIG. 2 illustrates an example of a saturation phenomenon observed in conventional LDO regulators. The input ramp signal at 16 causes the amplifier A to ramp up into the saturation region, turning on the transistor P as hard as possible, so the drain voltage 15 reaches the supply rail voltage of 3.5 volts. When the input signal 16 ramps back down, the LDO cannot easily recover from the saturation condition, so the falling edge of the voltage signal at drain 15 initially exhibits a near vertical step-down response followed by significant noise ringing, both of which are undesirable in RF communications. Moreover, the problem is typically exaggerated by the inductance associated with product packaging.

FIG. 3 also illustrates the response of the drain 15 to the input signal 16 of FIG. 1, together with the response of an internal node 31 within the amplifier A. As shown in FIG. 3, the internal node 31 experiences undesirable noise ringing associated with the falling edge ringing on drain 15.

It is desirable in view of the foregoing to provide an LDO regulator which can avoid the difficulties presently associated with recovering from operation in the hard saturation mode.

SUMMARY OF THE INVENTION

Exemplary embodiments of the invention can avoid a hard saturation mode of operation in an LDO regulator by providing an additional feedback control loop. The additional control loop cooperates with the LDO regulator's amplifier stage and output stage to maintain at least a minimum desired voltage drop across the output stage from the power supply to the load.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation. A controller may be implemented in hardware, firmware or software, or some combination of at least two of the same. It should be noted that the functionality associated with a controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

FIGS. 1 through 8, discussed herein, and the various embodiments used to describe the principles of the present invention in this patent document are by way of illustration only and should not be construed in any way to limit the scope of the invention. Those skilled in the art will understand that the principles of the present invention may be implemented in any suitably arranged system.

Exemplary embodiments of the invention can avoid a hard saturation mode of operation in an LDO regulator by providing an additional feedback control loop. In some embodiments, this control loop monitors the drain voltage of the output stage transistor with respect to the positive power supply rail voltage. In other embodiments, the control loop monitors the gate voltage of the output stage transistor with respect to the negative power supply rail voltage (e.g., the ground reference potential of the LDO regulator). By operation of the control loop, at least a minimum desired voltage drop can be maintained across the output stage from the power supply to the load.

Figure 1:
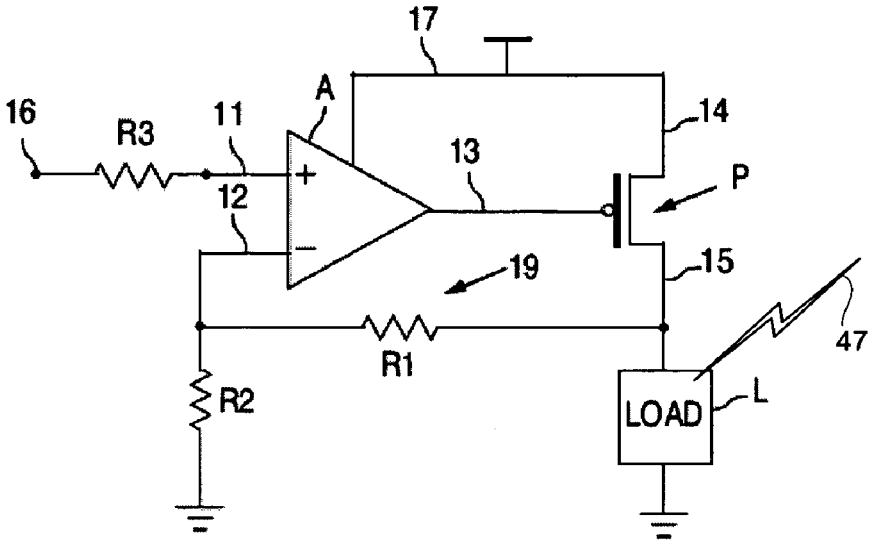
FIG. 1 (PRIOR ART)
FIG. 1 diagrammatically illustrates an LDO regulator circuit according to the prior art.
Figure 2:
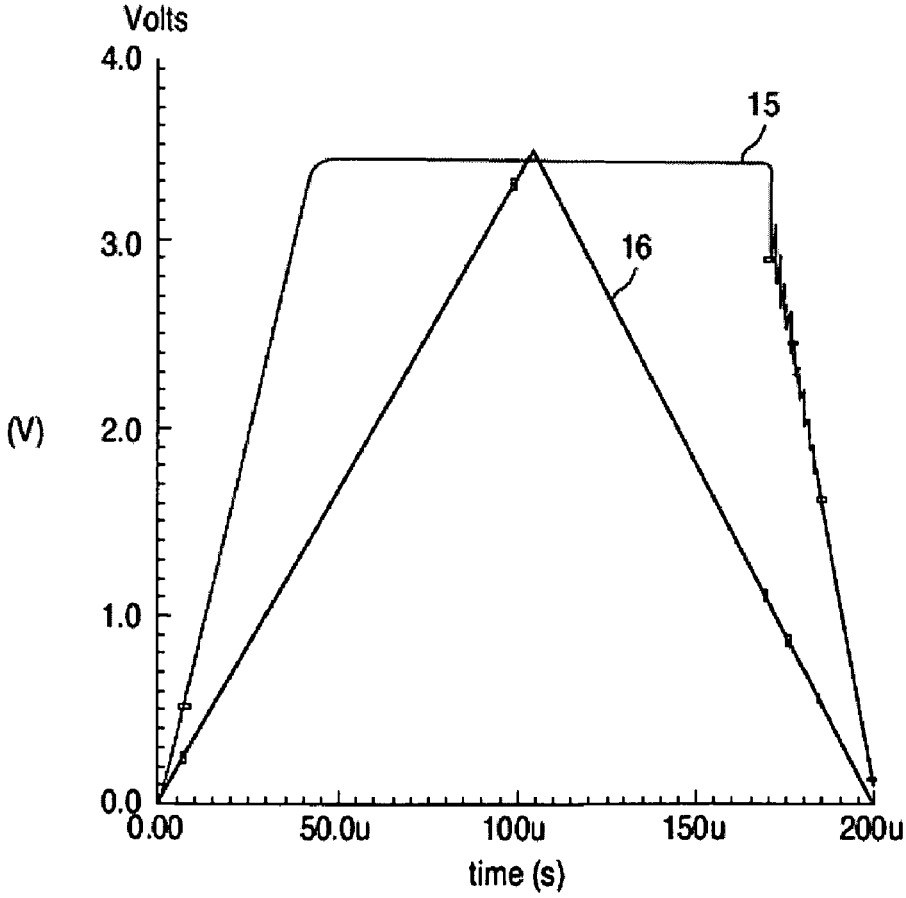
FIG. 2 (PRIOR ART)
FIGS. 2 and 3 graphically illustrate the operation of the LDO regulator circuit of FIG. 1 in hard saturation mode.
Figure 3:
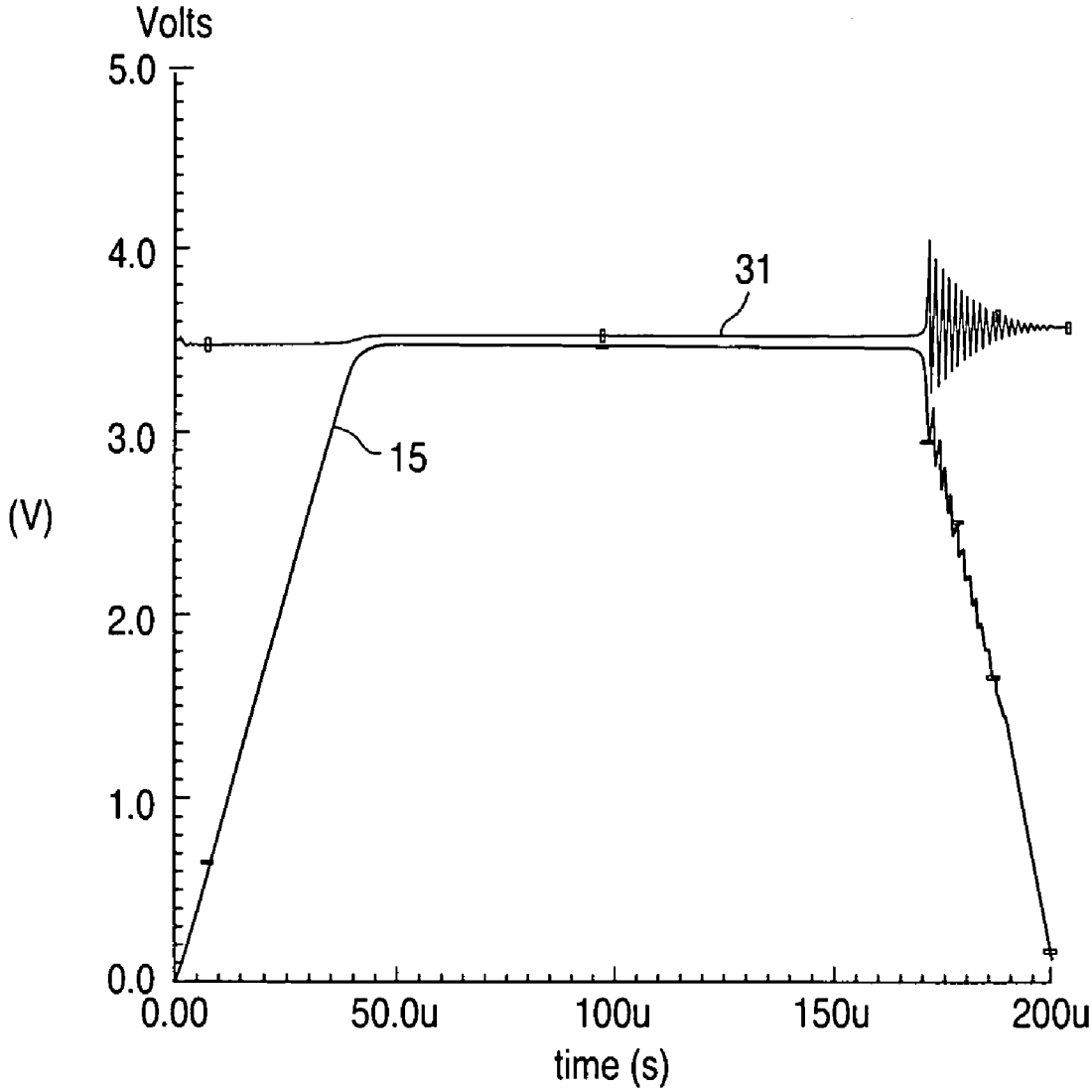
FIG. 3 (PRIOR ART)
Figure 4:
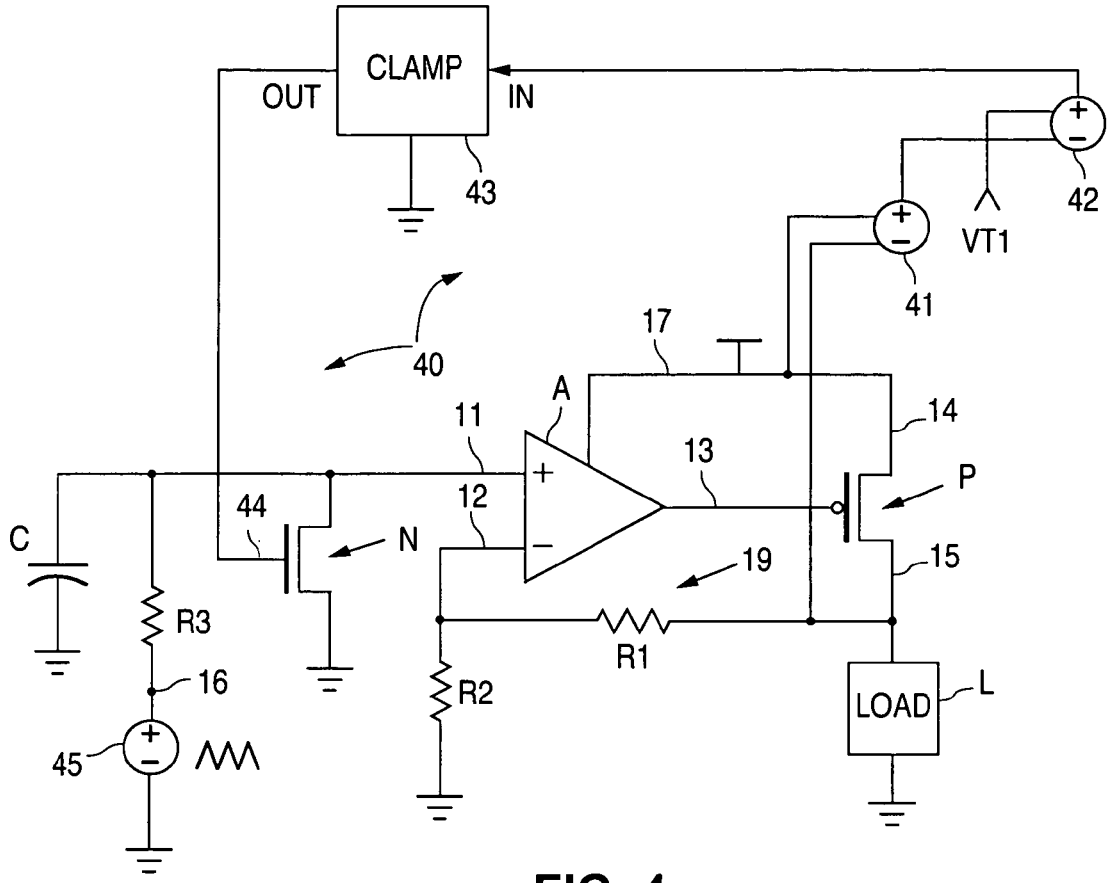
FIG. 4 diagrammatically illustrates an LDO regulator circuit according to exemplary embodiments of the invention.

FIG. 4 diagrammatically illustrates an LDO regulator circuit according to exemplary embodiments of the invention. In the circuit of FIG. 4, a feedback control loop shown at 40 monitors the voltage at the drain 15 of transistor P with respect to the positive power supply rail 17, and uses this information to keep the amplifier stage A out of hard saturation. The control loop circuit 40 includes an amplifier circuit that comprises constituent amplifier circuits 41 and 42. In some embodiments, the control loop amplifiers 41 and 42 are implemented as voltage-controlled voltage sources. The control loop circuit 40 also includes a clamp circuit 43, an N-channel transistor N, the resistor R3, and a capacitor C. Also illustrated in FIG. 4 is a precision ramp voltage source 45 (e.g., a DAC) which drives the input 16 of the LDO regulator circuit with a ramp signal.

In FIG. 4, the amplifier 41 has respective inputs which permit it to monitor the voltage on drain 15 of transistor P with respect to the positive power supply rail voltage 17. The amplifier 42 has respective inputs which permit it to monitor the output of the amplifier 41 with respect to a predetermined reference threshold voltage designated generally at VT1. In some embodiments, the gain of amplifier 42 is much higher than the gain of amplifier 41. For example, the gain of amplifier 42 could be 1000 while the gain of amplifier 41 could be unity. When the drain voltage 15 comes within the threshold voltage VT1 of the positive supply rail voltage 17, the output of amplifier 42 activates the input of a clamp circuit 43. The clamp circuit 43 has an output coupled to the gate 44 of the transistor N. The clamp circuit 43 is a conventional device which insures that, regardless of the voltage range seen at the output of the high gain amplifier circuit 42, the gate 44 of the transistor N will receive a voltage signal that is within the power supply rail limits of the LDO regulator circuit.

Due to the relatively high gain of the amplifier circuit 42, the transistor N will remain turned off until the voltage on the drain 15 of transistor P becomes very close to within VT1 volts of the positive power supply rail voltage 17. At this point, the transistor N is turned on to adjust the voltage at the non-inverting input 11 of the amplifier stage A appropriately to maintain the source-drain voltage drop across transistor P at least as large as the predetermined threshold voltage level VT1. This adjustment at the non-inverting input 11 effectively prevents the amplifier stage A from being overdriven into hard saturation. In some embodiments, the threshold voltage VT1 is set to 200 millivolts derived, for example, from an absolute reference circuit such as a bandgap reference circuit (not shown).

Figure 5:
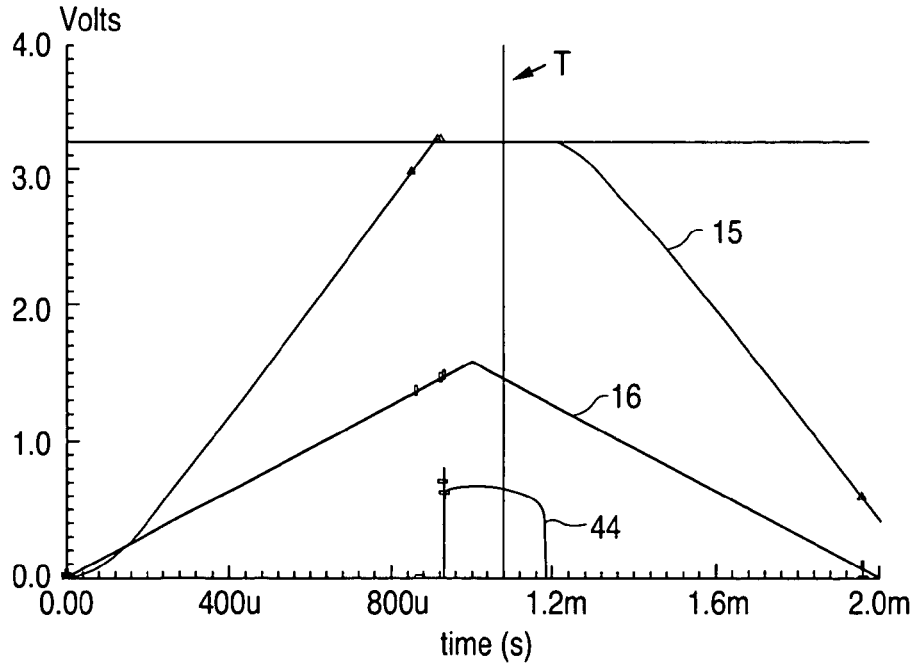
FIG. 5 graphically illustrates selected signals from the circuit of FIG. 4.

FIG. 5 graphically illustrates selected signals from the LDO regulator circuit of FIG. 4. As shown in FIG. 5, for a positive supply rail voltage of 3.5 volts, the drain voltage 15 of output stage transistor P is limited at 3.3 volts, which is 200 millivolts below the 3.5 volt supply level at the source 14 of transistor P. Also shown is the gate voltage 44 of transistor N, which remains at zero until the drain voltage at 15 reaches 3.3 volts, at which time the gate voltage transitions to approximately 616 millivolts, thereby maintaining the source-drain voltage drop across output stage transistor P at 200 millivolts until such time as the drain voltage begins to drop in response to the ramp down of the input signal 16. At that time, the gate voltage 44 returns to zero and the transistor N is turned off again.

Figure 6:
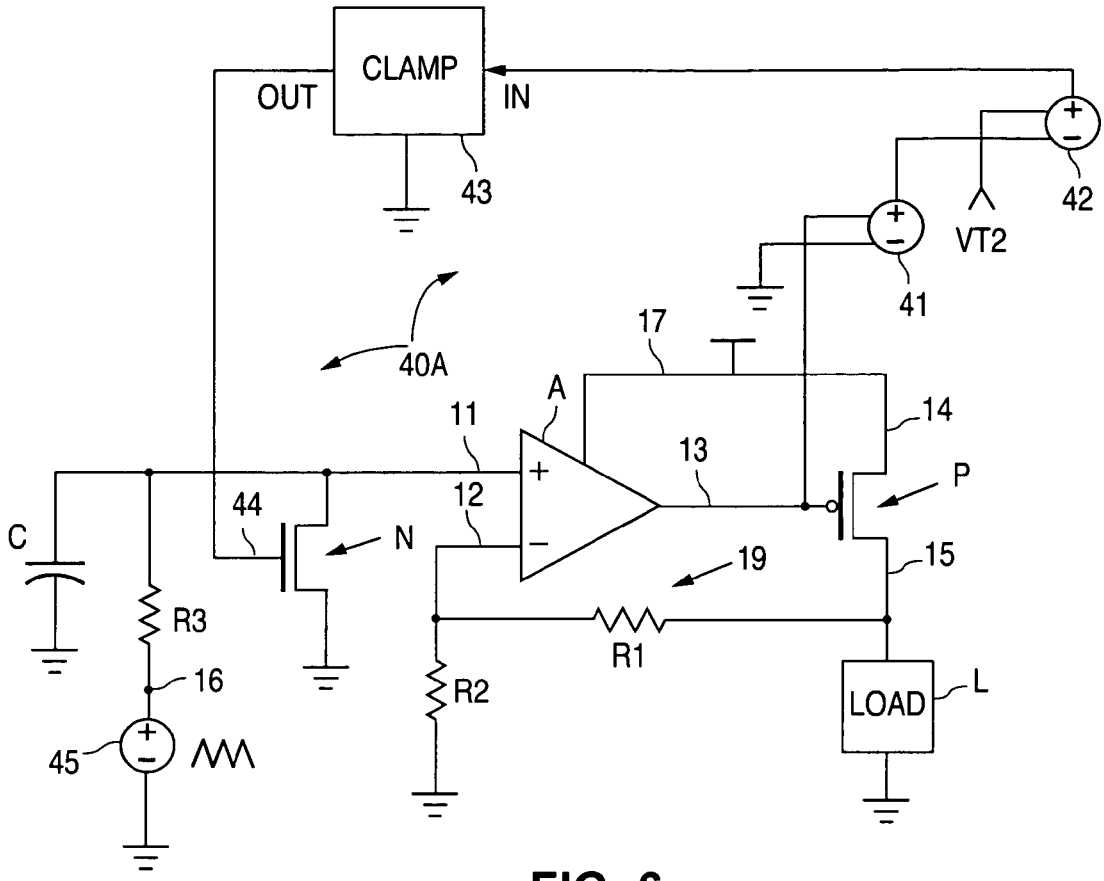
FIG. 6 diagrammatically illustrates an LDO regulator is circuit according to further exemplary embodiments of the invention.

FIG. 6 diagrammatically illustrates an LDO regulator circuit according to further exemplary embodiments of the invention. The LDO regulator of FIG. 6 is generally similar to the one of FIG. 4, except that in the feedback control loop 40A, the inputs of amplifier 41 are coupled to monitor the gate voltage of output stage transistor P relative to the negative power supply is rail voltage, that is, the ground reference of the LDO regulator circuit. The inputs of amplifier circuit 42 are coupled to monitor the output of amplifier circuit 41 with respect to a predetermined reference threshold voltage VT2. Thus, when the gate voltage of output stage transistor P comes within the threshold voltage VT2 of ground, the output of amplifier circuit 42 activates the input of the clamp circuit 43, thereby causing the output of clamp circuit 43 to turn on transistor N appropriately to adjust the voltage at the non-inverting input 11 of the amplifier stage A. In some embodiments, the threshold voltage VT2 is set to 500 millivolts, which can be derived from a suitable reference circuit such as a bandgap reference circuit (not shown).

Figure 7:
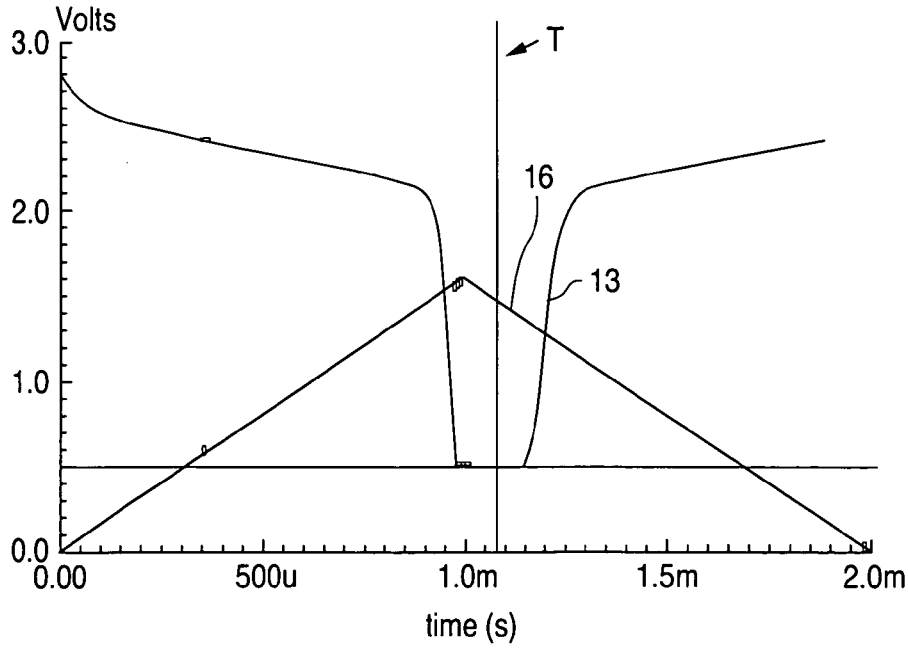
FIG. 7 graphically illustrates selected signals from the circuit of FIG. 6.

FIG. 7 graphically illustrates the input ramp signal 16 and the output 13 of the amplifier stage A, which output 13 is coupled to the gate of the output stage transistor P. As shown in the example of FIG. 7, operation of the control loop circuit 40A prevents the gate voltage from decreasing below a threshold voltage VT2 of 500 millivolts. Thus, the output stage transistor P is not turned on as hard as possible. This insures a suitable source-drain voltage drop across transistor P (e.g. 200 millivolts), and prevents the amplifier stage A from being overdriven into saturation. Note that time T is a common point of temporal reference in both FIGS. 5 and 7.

In some embodiments, the control loop circuits 40 and 40A in FIGS. 4 and 6 are designed to have a lower (for example 10% lower) bandwidth and a higher (for example 10% higher) phase margin than does the control loop circuit 19 defined by R1 and R2. Suitable values of R3 and C can be selected to insure that the aforementioned bandwidth and phase margin relationships are maintained. In general, the bandwidth difference and the phase margin difference should be better than the matching property of the semiconductor process used to produce the LDO regulator circuit. Accordingly, if the matching property of the semiconductor process is 2%, then the bandwidth of the control loops 40 and 40A should be more than 2% lower than the bandwidth of the control loop 19, and the phase margin of the control loops 40 and 40A should be more than 2% higher than the phase margin of the control loop, 19. The roll-off characteristic of the LDO regulator output signal 15 in FIGS. 5 and 7 can be controlled by the bandwidth design. A smooth roll-off characteristic is preferable for RF applications.

Figure 8A:
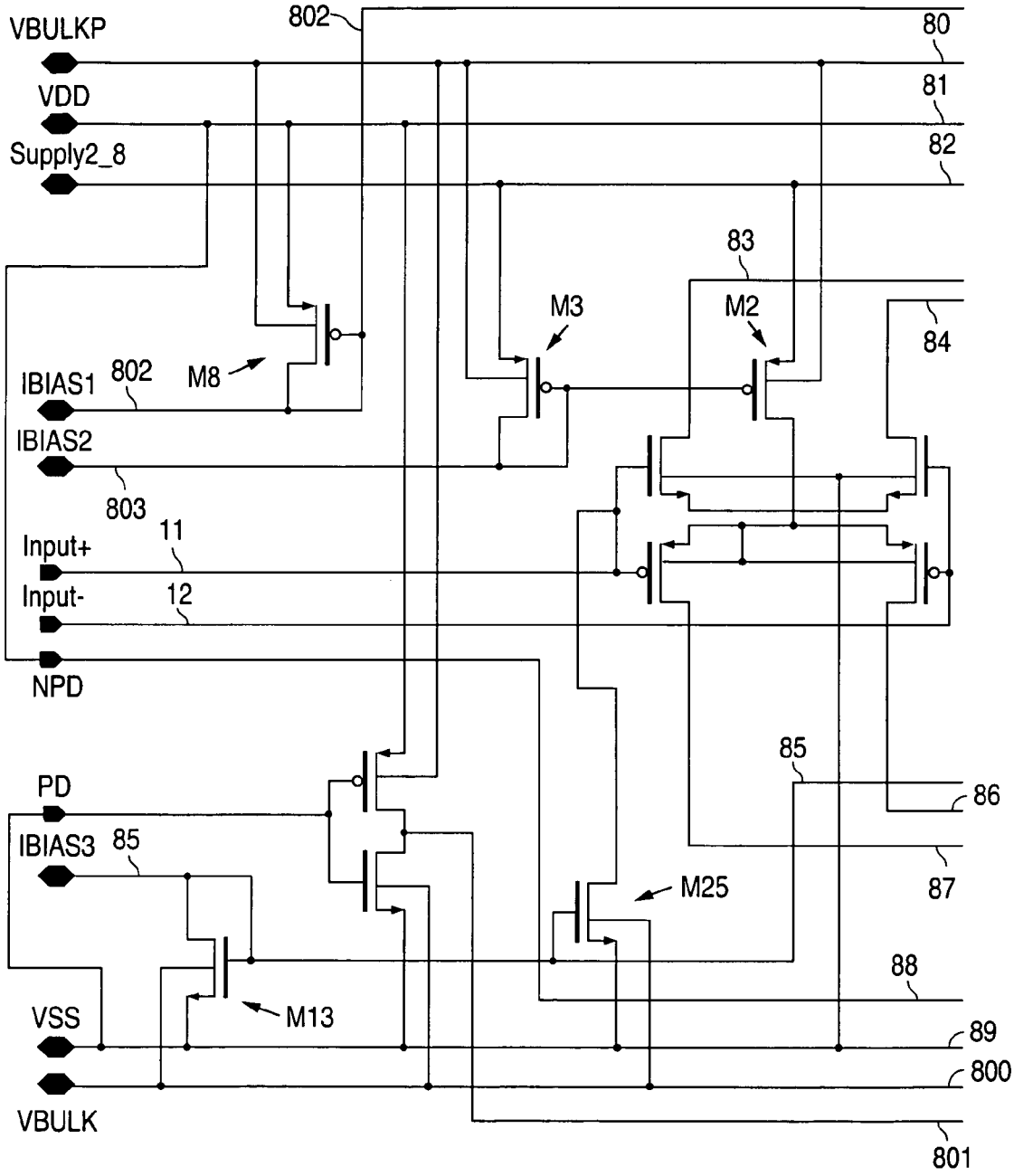
FIGS. 8A and 8B, taken together, provide a detailed example of an amplifier stage that can be used in the LDO regulators of FIGS. 4 and 6.
Figure 8B:
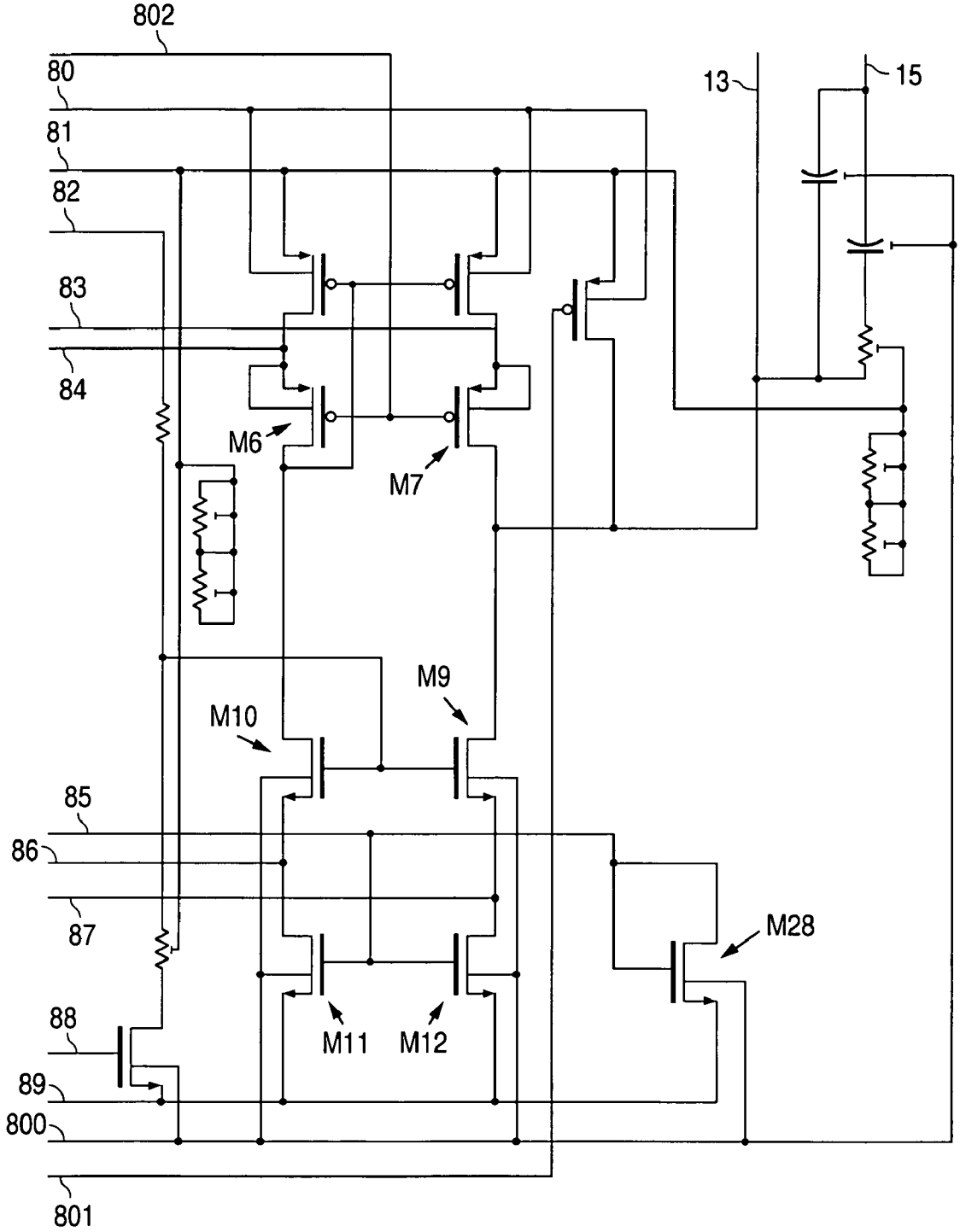

FIGS. 8A and 8B, taken together, illustrate an example of an amplifier stage which can be used instead of the conventional amplifier stage A in some embodiments. Nodes which are common to FIGS. 8A and 8B are designated in FIGS. 8A and 8B at 80-89, and 800-802. As shown in FIG. 8A, the amplifier utilizes three separate bias currents designated generally at 802(IBIAS1), 803 (IBIAS2) and 85 (IBIAS3). These separate bias currents are provided to permit individual control of the various internal stages of the overall amplifier topography, namely, a full-folded cascode topography with complementary input stages. As shown in FIGS. 8A and 8B, the bias current at 802 supports operation of P-channel transistors M6, M7 and M8, the bias current at 803 supports operation of P-channel transistors M2 and M3, and the bias current 85 supports operation of N-channel transistors M11-M13, M25 and M28. In some embodiments, the bias current 802 functions as a 1500 uA sink, the bias current 803 functions as a 100 uA sink, and the bias current 85 functions as a 10 uA source.

Also in FIGS. 8A and 8B, the input stage transistors are operated from a regulated supply voltage rather than from VDD as is conventional. More particularly, input stage transistors M2 and M3 are operated from a regulated supply voltage 82 (regulated to 2.8 volts in some embodiments). This use of a regulated supply voltage on the input stage permits realization of an improved common mode characteristic, particularly when the common mode has effectively narrowed the supply rail, i.e., when the input voltage does not go completely to the supply rail.

Although the present invention has been described with exemplary embodiments, various changes and modifications may be suggested to one skilled in the art. It is intended that the present invention encompass such changes and modifications as fall within the scope of the appended claims.

What is claimed is:

1. A voltage regulator comprising:

an amplifier stage operable to receive an input signal;

an output stage coupled to the amplifier stage, the output stage having a first terminal operable to be coupled to a power supply rail and a second terminal operable to be coupled to a load; and a control loop circuit coupled to the amplifier stage and the output stage, the control loop circuit operable to adjust the input signal so as to maintain at least a specified voltage drop between the first and second terminals of the output stage.

2. The voltage regulator of claim 1, further comprising:

a second control loop circuit coupled to the amplifier stage and the output stage, the second control loop circuit operable to set a gain of the voltage regulator.

3. The voltage regulator of claim 1, wherein the control loop circuit comprises:

a first amplifier circuit operable to receive voltages at the first and second terminals of the output stage; and a second amplifier circuit operable to receive an output of the first amplifier circuit and a reference voltage.

4. The voltage regulator of claim 1, wherein the control loop circuit comprises:

a first amplifier circuit coupled to an output of the amplifier stage and ground; and a second amplifier circuit operable to receive an output of the first amplifier circuit and a reference voltage.

5. The voltage regulator of claim 1, wherein the control loop circuit comprises:

a clamp circuit operable to generate a voltage signal; and a transistor coupled to an input of the amplifier stage and having a gate operable to receive the voltage signal from the clamp circuit.

6. The voltage regulator of claim 1, wherein the output stage comprises a transistor having a gate coupled to an output of the amplifier stage, a source operable to be coupled to the power supply rail, and a drain operable to be coupled to the load.

7. An apparatus comprising:

a load operable to receive a regulated voltage;

a signal source operable to generate a control signal; and a voltage regulator comprising:

an amplifier stage operable to receive the control signal;

an output stage coupled to the amplifier stage, the output stage having a first terminal coupled to a power supply rail and a second terminal coupled to the load; and a control loop circuit coupled to the amplifier stage and the output stage, the control loop circuit operable to adjust the control signal so as to maintain at least a specified voltage drop between the first and second terminals of the output stage.

8. The apparatus of claim 7, wherein the voltage regulator further comprises:

a second control loop circuit coupled to the amplifier stage and the output stage, the second control loop circuit operable to set a gain of the voltage regulator.

9. The apparatus of claim 7, wherein the control loop circuit comprises:

a first amplifier circuit operable to receive voltages at the first and second terminals of the output stage; and a second amplifier circuit operable to receive an output of the first amplifier circuit and a reference voltage.

10. The apparatus of claim 7, wherein the control loop circuit comprises:

a first amplifier circuit coupled to an output of the amplifier stage and ground; and a second amplifier circuit operable to receive an output of the first amplifier circuit and a reference voltage.

11. The apparatus of claim 7, wherein the control loop circuit comprises:

a clamp circuit operable to generate a voltage signal; and a transistor coupled to an input of the amplifier stage and having a gate operable to receive the voltage signal from the clamp circuit.

12. The apparatus of claim 7, wherein the output stage comprises a transistor having a gate coupled to an output of the amplifier stage, a source coupled to the power supply rail, and a drain coupled to the load.

13. The apparatus of claim 7, wherein the load comprises a signal amplifier operable to amplify signals for transmission on a communication channel.

14. The apparatus of claim 13, wherein:

the signal amplifier comprises a radio frequency (RF) amplifier; and the control signal comprises a time division multiple access (TDMA) control signal.

15. A method comprising:

receiving a control signal and generating an output voltage using a voltage regulator, the voltage regulator comprising an amplifier stage and an output stage, the output stage having a first terminal coupled to a power supply rail and a second terminal coupled to a load; and adjusting the control signal so as to maintain at least a specified voltage drop between the first and second terminals of the output stage.

16. The method of claim 15, wherein adjusting the control signal comprises adjusting the control signal using a first control loop circuit; and further comprising setting a gain of the voltage regulator using a second control loop.

17. The method of claim 15, wherein adjusting the control signal comprises:

receiving voltages from the first and second terminals of the output stage at a first amplifier circuit; and receiving an output of the first amplifier circuit and a reference voltage at a second amplifier circuit.

18. The method of claim 15, wherein adjusting the control signal comprises:

receiving an output of the amplifier stage and a ground potential at a first amplifier circuit; and receiving an output of the first amplifier circuit and a reference voltage at a second amplifier circuit.

19. The method of claim 15, wherein adjusting the control signal comprises:

generating a voltage signal using a clamp circuit; and providing the voltage signal to a gate of a transistor, the transistor coupled to an input of the amplifier stage.

20. The method of claim 15, wherein the output stage comprises a transistor having a gate coupled to an output of the amplifier stage, a source coupled to the power supply rail, and a drain coupled to the load.

* * * * *